US007134946B1

(12) United States Patent
Jackson

(10) Patent No.: US 7,134,946 B1
(45) Date of Patent: Nov. 14, 2006

(54) APPARATUS TO TREAT AND INSPECT A SUBSTRATE

(75) Inventor: David P. Jackson, Saugus, CA (US)

(73) Assignee: Cool Clean Technologies, Inc., Eagan, MN (US)

( * ) Notice: Subject to any disclaimer, the term of this patent is extended or adjusted under 35 U.S.C. 154(b) by 0 days.

(21) Appl. No.: 11/301,465

(22) Filed: Dec. 13, 2005

Related U.S. Application Data

(60) Provisional application No. 60/635,400, filed on Dec. 13, 2004.

(51) Int. Cl.
*B24C 3/12* (2006.01)

(52) U.S. Cl. ..... 451/75; 451/78; 451/87; 134/10; 134/902

(58) Field of Classification Search ..... 451/38–40, 451/53, 75, 78, 80, 87–89, 102; 134/10, 134/19, 38, 21, 40, 72, 902
See application file for complete search history.

(56) References Cited

U.S. PATENT DOCUMENTS

| | | | | |
|---|---|---|---|---|
| 1,993,696 | A | 3/1935 | Allen et al. | |
| 4,832,753 | A | 5/1989 | Cherry et al. | |
| 5,062,898 | A | 11/1991 | McDermott et al. | |
| 5,315,793 | A * | 5/1994 | Peterson et al. | 451/2 |
| 5,599,223 | A * | 2/1997 | Mains Jr. | 451/39 |
| 5,766,061 | A | 6/1998 | Bowers | |
| 5,853,962 | A | 12/1998 | Bowers | |
| 5,931,721 | A | 8/1999 | Rose et al. | |
| 5,989,355 | A * | 11/1999 | Brandt et al. | 134/6 |
| 6,066,032 | A * | 5/2000 | Borden et al. | 451/80 |
| 6,099,396 | A * | 8/2000 | Krone-Schmidt | 451/80 |
| 6,173,916 | B1 | 1/2001 | Krone-Schmidt | |
| 6,203,406 | B1 | 3/2001 | Rose et al. | |
| 6,358,120 | B1 * | 3/2002 | Poling et al. | 451/40 |
| 6,530,823 | B1 * | 3/2003 | Ahmadi et al. | 451/39 |
| 6,543,462 | B1 * | 4/2003 | Lewis et al. | 134/144 |
| 6,764,385 | B1 | 7/2004 | Boumerzoug et al. | |
| 6,824,450 | B1 | 11/2004 | Opel | |
| 6,852,173 | B1 | 2/2005 | Banjeree et al. | |
| 2004/0055621 | A1 | 3/2004 | McDermott et al. | |
| 2004/0055624 | A1 | 3/2004 | McDermott et al. | |

* cited by examiner

*Primary Examiner*—Lee D. Wilson
*Assistant Examiner*—Anthony Ojini
(74) *Attorney, Agent, or Firm*—DuFault Law Firm, P.C.

(57) ABSTRACT

An apparatus for treating a substrate with a cryogenic impingement fluid includes a protective enclosure defining an internal cavity, a cryogenic fluid applicator positioned within the internal cavity and a snow generation system connected to the cryogenic fluid applicator. The snow generation system includes a condensing subsystem and a diluent or propellant gas subsystem. Each subsystem is connectable to a common gas source. The condensing subsystem includes a condenser for condensing liquid carbon dioxide into solid carbon dioxide particles, or dry ice snow. The condenser includes at least two segments of differing diameter connected to one another. Liquid carbon dioxide is introduced into the smaller diameter first segment and upon entering the larger diameter second segment, solidifies into dry ice particles. The dry ice particles, along with diluent or propellant gas produced from the diluent subsystem, are delivered to the cryogenic fluid applicator via a coaxial delivery tube.

20 Claims, 5 Drawing Sheets

APPARATUS TO TREAT AND INSPECT A SUBSTRATE

CROSS-REFERENCE TO RELATED APPLICATION(S)

This application claims the benefit U.S. Provisional Patent Application No. 60/635,400 entitled MEHTOD AND APPARATUS FOR SELECTIVELY TREATING AND INSPECTING A SUBSTRATE filed on 13 Dec. 2004 which is hereby incorporated herein by reference.

BACKGROUND OF INVENTION

The present invention generally relates to the field of environmental control for performing cryogenic spray cleaning processes. More specifically, the present invention is directed at cleaning or treating miniature electromechanical device surfaces with cryogenic impingement sprays.

Conventional precision cleaning processes using cryogenic particle impingement sprays, such as solid phase carbon dioxide, require control of the atmosphere containing a treated substrate to prevent the deposition of moisture, particles or other such contaminants onto surfaces during and following cleaning treatments. Environmental control is required because of localized atmospheric perturbations created by the low temperatures and high velocities which are characteristic of these impingement cleaning sprays.

For example, snow particles having a surface temperature of −100 F and traveling through the space between a spray nozzle and a substrate are continuously sublimating in transit and upon impact with the substrate. This rapidly lowers local ambient atmospheric temperature causing contaminants contained therein to condense or "rain-out" of the local atmosphere and onto treated substrate surfaces during or following spray treatments. Moreover, by way of the Bernoulli effect, the cleaning spray stream exhibits lower internal pressure than the surrounding atmosphere which creates venturi currents adjacent to the flow of the stream. These venturi currents cause the local atmosphere surrounding the stream to collapse into the spray stream above the substrate, thus entraining and delivering a mixture of cleaning spray and atmospheric constituents to the substrate. Finally, static charge build-up and accumulation are common to cryogenic sprays due to dielectric and triboelectric characteristics. This presents problems including, for example, potential device damage from electrostatic overstress or electrostatic discharge, and attraction of atmospheric contaminants to treated substrates via electrostatic attractive forces.

Micro-environmental control technology is well established and many techniques have been developed over the years to isolate either a process, a substrate or a worker. The purpose of isolation generally includes protecting workers from toxic chemicals, protecting clean rooms from particles, or protecting delicate processes and substrates from the outside environment.

There are many examples of techniques to control thermal and electrostatic effects during cryogenic impingement sprays using secondary heated or ionized jets or sprays above the substrate surface and delivered either independently or as a component of the cryogenic spray have been used commercially. For example, U.S. Pat. No. 5,409,418 issued to Krone-Schmidt et al. and U.S. Pat. No. 5,354,384 issued to Sneed et al. suggest direct heated or ionized gas impingement techniques and apparatus for heating, purging and deionizing substrate surfaces. The '384 patent suggests the use of a heated gas, such as filtered nitrogen, to provide a pre-heat cycle to a portion of a substrate prior to snow spray cleaning and a post-heat cycle to the substrate following the snow cleaning. This approach relies on "banking heat" into the substrate portion prior to cryogenic spray cleaning by delivering a heated gas stream to a portion of substrate to prevent moisture deposition and adding heat from a heated gas following cryogenic spray treatment. The '384 patent is primarily useful for removing high molecular weight materials such as waxes and adhesive residues having weakened cohesive energy from surfaces by partially melting or softening them prior to spray treatment. However, the approach of the '384 patent does not work well for most substrate treatment applications because many materials being cleaned, or at least portions thereof, have low thermal conductivity, low mass or because highly thermal conductive materials rapidly lose heat to the sublimating snow during impact. This tends to create localized cold spots on even a mostly hot bulk substrate. Examples of such substrates include ceramics, glasses, silicon and other semiconductor materials, as well as most polymers. Additionally, many electromechanical devices being cleaned are relatively small, providing no appreciable mass for storing heat. Such examples include photodiodes, fiber optic connectors, optical fibers, end-faces, sensors, dies, and CCD's, among many others.

Most significantly, directing a heating spray, or any secondary fluid for that matter, directly at or incident to the substrate surface during and/or following cryogenic cleaning spray treatments causes the entrainment, delivery and deposition of atmospheric contaminants as discussed above. This necessitates housing the cryogenic spray applicator, substrate and secondary gas jets in large, bulky and complex environmental enclosures employing HEPA filtration and dry inert atmospheres, such as included in U.S. Pat. No. 5,315,793, issued to Peterson et al.

In the '418 patent, an apparatus is taught for surrounding the impinging cryogenic spray stream with an ionized inert gas. It is proposed that by surrounding a stream of solid-gas carbon dioxide with a circular stream of ionized gas and applying the two components to the substrate simultaneously controls or eliminates electrostatic discharge at the surface during impingement. However, as also suggested by the '384 patent, the '418 patent suggests secondary stream that entrains, delivers and deposits atmospheric contaminants upon the substrate surfaces being treated. Moreover, contact of the ionizing gas with the stream prior to contact with the surface rapidly eliminates ion concentration and is ineffective in controlling electrostatic dishcarge. Still moreover, using the ionizing spray of the '418 patent independent of the snow spray and which is directed at an angle incident to the surface will further re-contaminate the substrate unless, as taught in the '793 patent, the entire operation is performed in a controlled HEPA filtered chamber.

As devices become smaller and their complexity increases, it is clearly desirable to have a improved processing technique, including a method and apparatus, that enables the use of environmentally safe cleaning agents to remove unwanted organic films and particles. It is desirable to have a technique which prevents additional particles and residues from being deposited on critical surfaces during application of said impingement cleaning sprays. The complete environmental control technique should include all of the basic environmental controls of thermal control, ionization control, and providing a dry and particle free cleaning atmosphere, but not negatively impacting the performance of the impinging cleaning spray. Moreover it would be highly desirable to have a cleaning capability integrated with the aforementioned controlled environment which provides a compact in-line or bench-top critical cleaning solution for manufacturing operations.

BRIEF SUMMARY OF INVENTION

The apparatus of the present invention includes a protective enclosure within which is positioned a cryogenic fluid applicator for treating and inspecting a substrate placed therein. The protective enclosure is partially open to the atmosphere and includes a filtered air circulation system and ionization mechanism to provide for a partially-pressurized, heated and ionized re-circulated atmosphere within the protective enclosure to prevent contamination of the substrate. The re-circulated atmosphere flows at a controlled velocity in a manner consistent with the geometry of the cavity and substrate being treated so as not to produce undue turbulence and erratic flow lines within the cavity. The substrate may be held within the cavity by means of a vacuum fixture, operator hands or other suitable fixture. Alternatively, the substrate may be inserted within the partial enclosure, treated and removed using an external robot or conveyed through each side using an automated track.

The present invention further includes a snow generation system connected to the cryogenic fluid applicator. The snow generation system includes a stepped capillary condenser having at least two connected segments of tubing with differing diameters to provide increased Joule-Thompson cooling in the conversion of liquid carbon dioxide to solid carbon dioxide, which reduces clogging and sputtering, improves jetting, and allows for greater spray temperature control. Moreover, the stepped capillary condenser produces coarser particles than a single step capillary.

DETAILED DESCRIPTION

Figure 1:
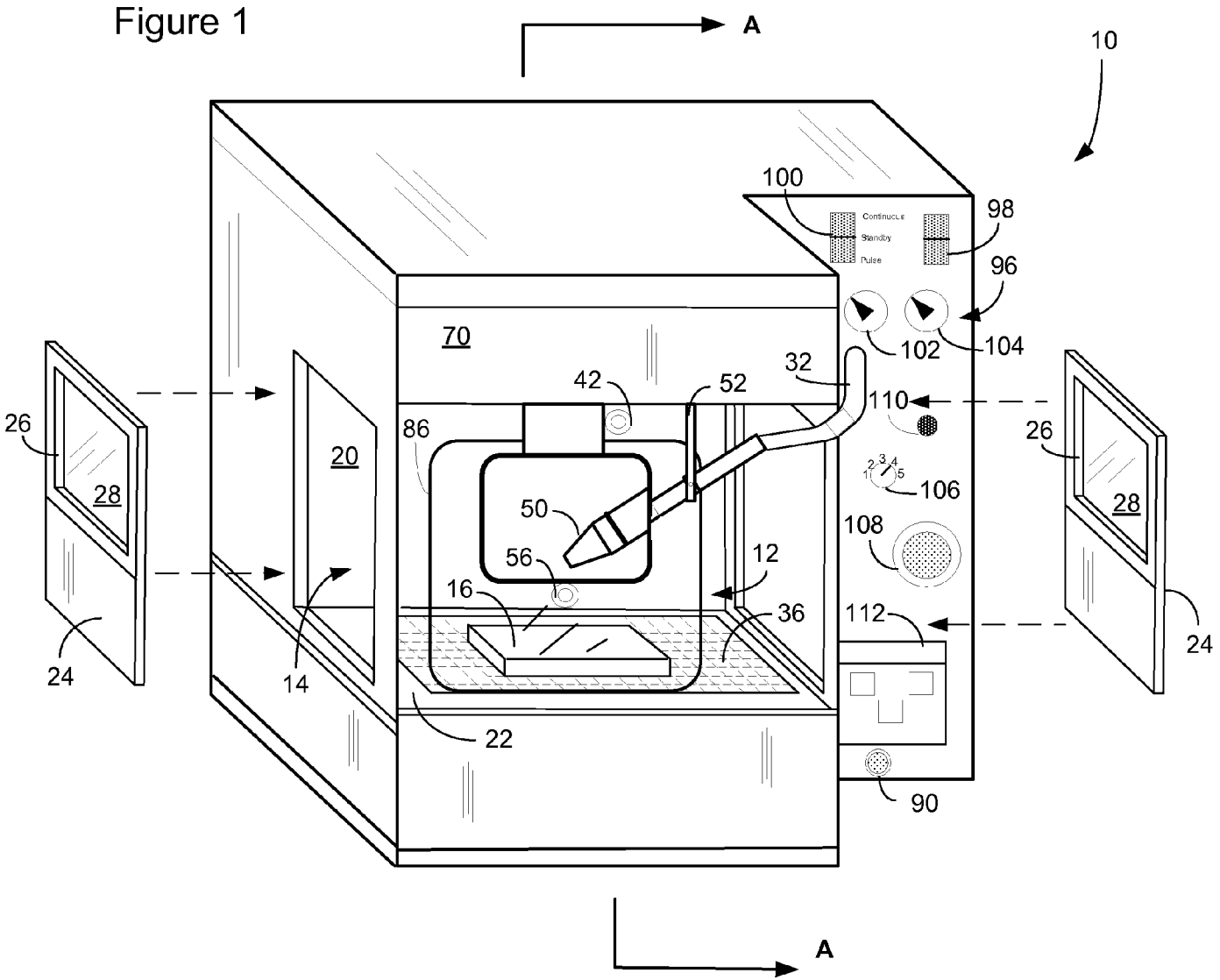
FIG. 1 is a perspective view of the present invention.
Figure 2:
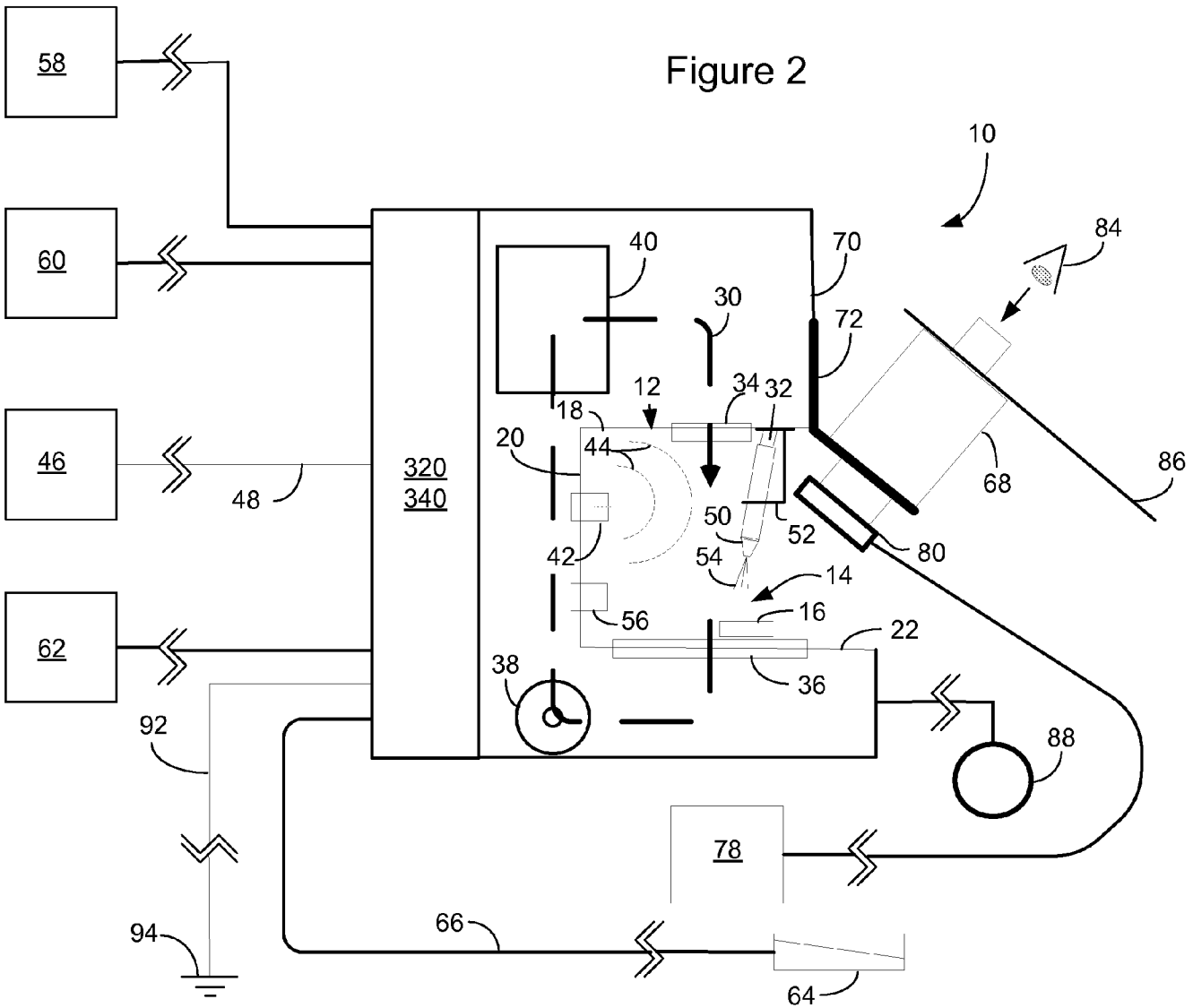
FIG. 2 is a side-view of the present invention taken along lines A—A in FIG. 1.

An apparatus to selectively treat and inspect a substrate is generally indicated 10 in FIGS. 1 and 2. The apparatus 10 includes a protective enclosure 12 which defines a mini-environment or cavity 14 for providing an instantaneous curtain or sheath of re-circulated and controlled atmosphere when treating or inspecting substrates 16 positioned therein. The protective enclosure 12 includes a ceiling, 18 walls 20, base 22 and removable electrostatic-discharge dissipative side panels 24, all of which provide a partial enclosure about the substrate 16 during processing and thus forming the cavity 14 therein. Each side panel 24 includes an upper aperture 26 containing a pane of transparent material 28 to allow further lighting within the cavity 14. The protective enclosure 12 is designed to have a portion open to the ambient atmosphere for insertion of the substrate 16 to be treated. The enclosure 12 may be constructed of any variety of materials including, but no limited to, metals, ceramics, glasses and conductive or electrostatic-discharge dissipative polymers, and combinations thereof. While it is preferable that the protective enclosure 12 include a substantially box-style configuration, it should be noted that the protective enclosure 12 may be formed of any geometrical shape in order to accommodate the substrate 16 to be treated. The substrate 16 may be held within the cavity 14 by means of a vacuum fixture (not shown), operator hands or other suitable fixture. Alternatively, the substrate 16 may be inserted, articulated, cleaned and removed using an external robot or conveyed through each side using an automated track, as will be discussed in greater detail.

A re-circulated atmosphere 30, which may be ionized, flows at a controlled velocity in a manner consistent with the geometry of the protective enclosure 12 and substrate 16 being treated so as not to produce undue turbulence and erratic flow lines within the cavity 14. Thus the airflow may be circular, rectangular or any other shape as desired to form the appropriate flow patterns within the open cell cavity 14. Still moreover, the protective enclosure 12 may be designed to be interchangeable to accommodate any number of substrates 16 and substrate geometries, such as reel-to-reel substrates (not shown). The internal cavity 14 is further bounded above and below, respectively, by a regenerated heated clean air outlet plenum 34 positioned within the ceiling 18 and a return air plenum 36 positioned within the base 22 for capturing contaminated air. A regenerated and heated atmosphere 30 is derived by re-circulating air from the perforated return air plenum 36. The regenerated atmosphere 30 is fed through an integrated heater-blower motor 38 and through a filter cartridge 40. The filter cartridge 40 is preferably an ultra low penetration air (ULPA) filter, however, other suitable filters known in the art are well within the scope of the present invention. The regenerated atmosphere 30 flows in a circular motion from the outlet plenum 34, through the cleaning cavity 14, and down through the return plenum 36. Alternatively, various baffles or diffusers (not shown) may be affixed to the outlet plenum 34 to re-direct or diffuse clean air flow over the substrate 16. The apparatus 10 of the present invention further includes an internal point ionizer 42 positioned within cleaning cavity 14 to provide DC, AC or photon ionization 44 to the clean air flow 30. The ionizer 42 is powered by an ionization power supply 46 connected via a power cable 48 to the ionizer 42. The regenerated atmosphere 30 re-circulates between the space comprising above cavity ceiling, along cavity walls, and downward through the return plenum 36 in the base 22 of the protective enclosure 12 resulting in the substrate 16 being contained between the ceiling 18, walls 20, and base 22, protected from ambient atmosphere in a sheath of clean dry ionized atmosphere.

To treat the substrate 16, a carbon dioxide spray treatment nozzle 50 is positioned within the enclosure 12 by means of a bracket 52. The spray treatment nozzle 50 is preferably positioned such that an emitted spray 54 is directed at a suitable angle and distance from the exemplary substrate 16 to perform the snow treatment operations. The spray treatment nozzle 50 is preferably a co-axial nozzle as taught by the present inventor and fully disclosed in U.S. Pat. No. 5,725,154, which is hereby incorporated herein by reference. More preferably, the spray treatment nozzle is a tri-axial type delivering apparatus as taught by the present inventor and fully disclosed in U.S. Provisional Application No.

60/726,466, which is also hereby incorporated herein by reference. It should be noted, though, that any type of nozzle capable of emitting carbon dioxide, in either solid or plasma phases, is well within the scope of the present invention.

A proximity sensor 56 is also positioned within the cavity to detect the presence of the substrate 16 to automatically start or stop the heater-blower motor 38 and ionizer 42. Also connected to the apparatus 10 are a supply of clean-dry-air or CDA 58, a supply of carbon dioxide liquid or gas 60 and a source of electrical power 62. An electronic actuator, such as a footswitch 64, is connected to the apparatus 10 using a suitable electronic control cable 66.

An inspection device 68, including for example a stereo microscope or CCD camera and monitor, is removably affixed to a front panel 70 by means of a mounting bracket 72 to be in visual communication with the spray applicator 50 and substrate 16. Alternatively, the inspection device 68 can be situated using a separate stand (not shown). To aid in the inspection, a light source 78 is connected to the inspection device 68 using a ring light 80. To prevent an operator 84 from introducing human contaminants such as skin or hair into the micro-environment during cleaning and inspection operations, a transparent sneeze guard 86 is included. The operator may be grounded via a wrist strap 88 and grounding element (now shown) through a suitable ground connection plug 90 which provides electrostatic discharge protection for the substrate 16 being treated by the operator 84. Alternatively, the grounding element (not shown) may be connected directly to the exemplary substrate 16 being treated and inspected. For further grounding of the apparatus 10, a common grounding bus is provided internally which is connected to a suitable ground 94.

In operation, the operator 84 positions the substrate 16 within the cleaning cavity 14. Upon so doing, the proximity sensor 56 activates to turn on the heater-blower motor 38 and ionizer 42. The operator 84 then depresses the footswitch 64 to activate a snow generation system 320 or 340, whereby high-velocity snow particles travel from the system via delivery conduit 32 and emit from spray applicator to be directed at the substrate 16 for treatment. Preferably, the snow treatment system 320 or 340 is that as taught by the present inventor and fully disclosed in U.S. application Ser. No. 11/301,442 entitled CARBON DIOXIDE SNOW APPARATUS, filed concurrently with the present application and claiming priority from U.S. Provisional Application No. 60/635,230, both of which are hereby incorporated herein by reference.

Figure 3:
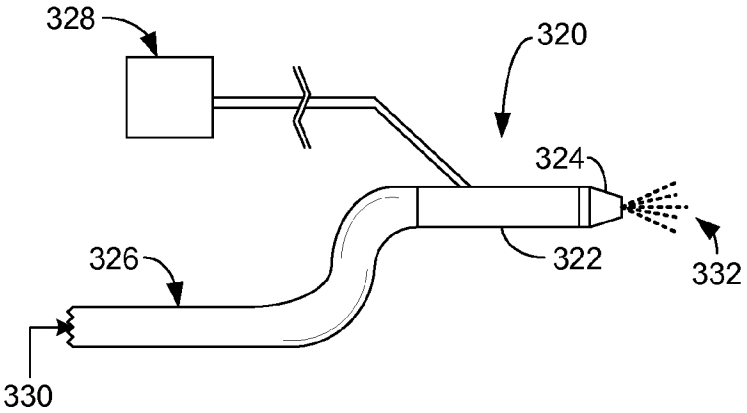
FIG. 3 is an illustrated perspective view of a carbon dioxide snow treatment apparatus of the present invention.
Figure 4:
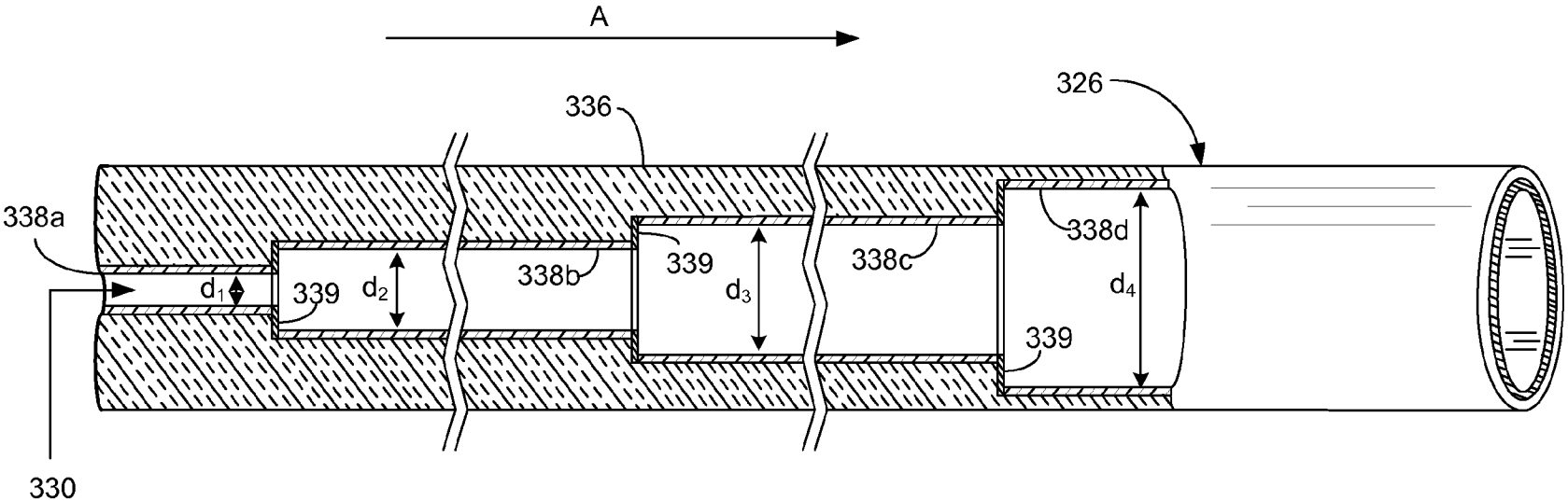
FIG. 4 is a partial cross sectional view of the carbon dioxide snow treatment apparatus of FIG. 3.

The carbon dioxide snow treatment system 320 is generally indicated at 320 in FIG. 3. A dense fluid 330, preferably liquid carbon dioxide, enters the capillary condenser 326 whereupon passing therethrough, or in conjunction with the applicator 322, is condensed and solid carbon dioxide snow 332 exits the mixing spray nozzle along with the propellant gas 328 or any uncondensed carbon dioxide. Referring to FIG. 4, the capillary condenser 326 includes a capillary tube 334 covered by suitable insulation 336, such as such as for example, 0.318 cm (0.125 inch) of self-adhering polyurethane insulation foam tape as supplied by Armstrong World Industries, Inc. of Lancaster, Pa., which is wrapped about the capillary tube 34 in a helical fashion with 50% overlap. The capillary tube 334 includes segmented capillaries 338 that have step-wise increasing diameters, indicated by $d_1$, $d_2$, $d_3$ and $d_4$, respectively, which increase in a feed-wise direction, indicated by arrow A. Thus, $d_1<d_2<d_3<d_4$. It should be noted, though, that capillary tube 334 of FIG. 4 is for illustrative purposes only, and that the capillary tube 334 of the present invention need only include at least two segments 338, and it is well within the scope of the present invention to provide a capillary tube 334 with three or more segments 38 as well, depending upon the particular application. The capillary 334 is preferably constructed of a PolyEtherEtherKetone (PEEK) polymer. However, other suitable tubular materials are well within the scope of the present invention including, but not limited to, Teflon® or other clean and flexible materials. As stated, the capillary condenser tube 334 includes at least two segments 338, with each segment 338 preferably having a length ranging from 0.3 m (1 foot) to 7.32 m (24 feet) and inside diameters ranging from 0.127 mm (0.005 inches) to 3.175 mm (0.125 inches). Such tubing should be able to withstand propellant gas pressures ranging up to about 7 MPa (1000 psi) and temperatures ranging between 203 K and 473 K. The interconnections 339 between the segments may be Swagelok or finger-tight compression fittings.

Figure 5:
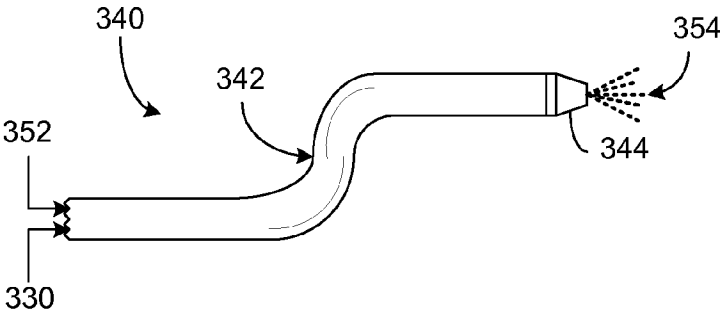
FIG. 5 is an illustrated perspective view of an alternative embodiment of a snow treatment apparatus of the present invention.
Figure 6:
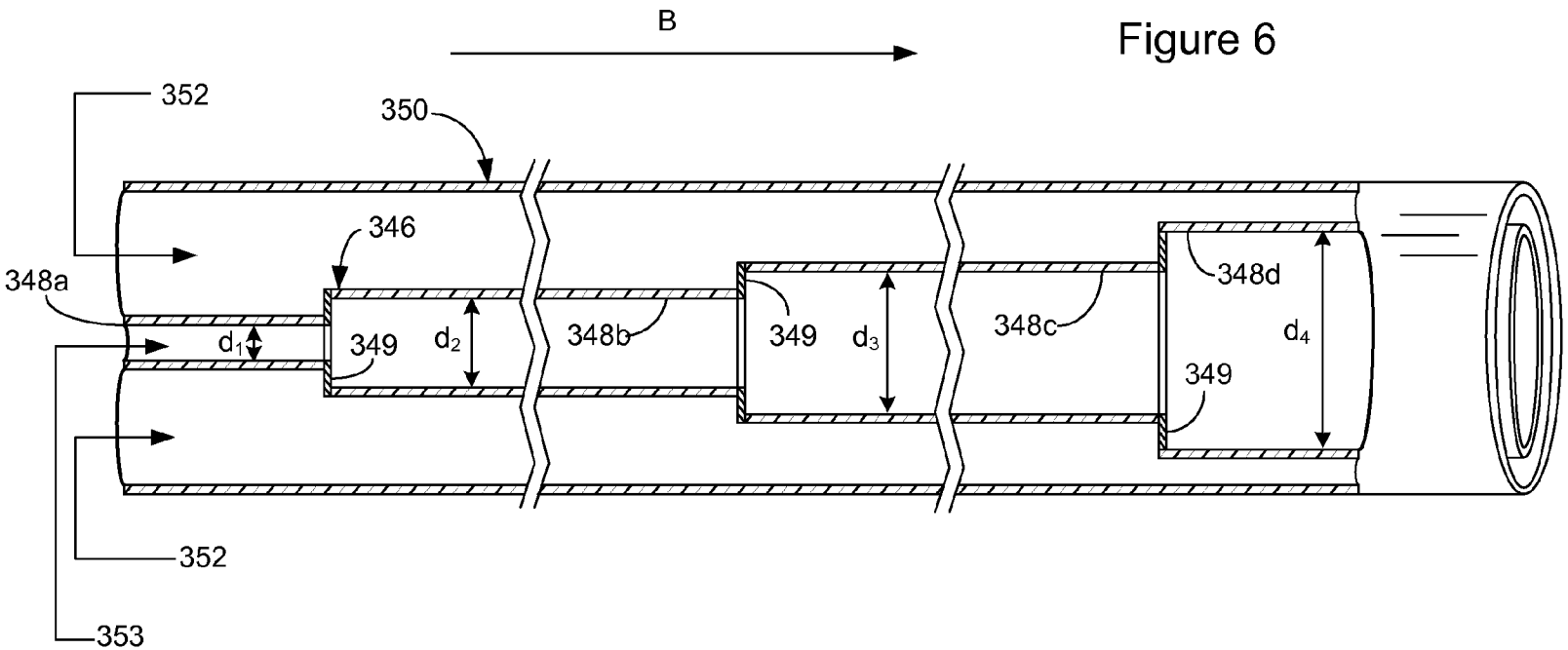
FIG. 6 is a partial cross sectional view of the alternative embodiment of a snow treatment apparatus of FIG. 5.

FIGS. 5 and 6 illustrate an alternative carbon dioxide snow treatment apparatus 340 of the present invention including a flexible capillary condenser 342 connected to a divergent/convergent nozzle 344. The capillary condenser 342 similarly includes a capillary tube 346 having segmented capillaries 348*a*, 348*b*, 348*c* and 348*d* that have step-wise increasing diameters $d_1$, $d_2$, $d_3$ and $d_4$, respectively, which increase in a feed-wise direction, indicated by arrow B. The capillary 342 is preferably constructed of PEEK polymer. However, other suitable tubular materials are well within the scope of the present invention including, but not limited to, Teflon® or other clean and flexible materials. As stated, the capillary condenser tube 342 includes at least two segments 348, with each segment 348 preferably having a length ranging from 0.3 m (1 foot) to 7.32 m (24 feet) and inside diameters ranging from 0.127 mm (0.005 inches) to 3.175 mm (0.125 inches). Such tubing should be able to withstand propellant gas pressures ranging up to about 7 MPa (1000 psi) and temperatures ranging between 203 K and 473 K. The interconnections 349 between the segments may be Swagelok or finger-tight compression fittings. The capillary tube 342 is positioned within a propellant gas tube 350. A heated propellant gas 352 is carried within the flexible propellant delivery tube 350 to the nozzle 344. The propellant tubing 350 may be constructed of any number of suitable tubular materials including Teflon, Stainless Steel overbraided Teflon®, Polyurethane, Nylon, among other clean and flexible materials having lengths ranging from 0.3 m (1 foot) to 7.3 m (24 feet) or more and inside diameters ranging from about 0.65 cm (0.25 inches) to about 1.3 (0.50 inches). Such tubing 346 should be able to withstand propellant gas pressures ranging between about 0.07 MPa (10 psi) and 1.72 MPa (250 psi) and temperatures ranging between 293 K and 473 K. The exemplary flexible condenser 342 of the alternative embodiment 340 is terminated with the rigid mixing spray nozzle 344 which contains a convergent mixing nozzle portion and a divergent expansion nozzle portion (not shown) as is known in the art. Dense fluid 353, preferably liquid carbon dioxide, enters the capillary assembly 346 and forms carbon dioxide snow particles as the carbon dioxide progresses through the at least two capillary segments 348. Upon entering the nozzle 344, carbon dioxide snow particles discharge from the capillary condenser assembly 346, mixing with propellant gas 352 discharged from the propellant aerosol tube 350, thus forming a solid-gas carbon dioxide spray 354. The carbon dioxide aerosol spray 354 discharges from the nozzle 344 and is selectively directed at a substrate surface (not shown).

Being that both embodiments 320 and 340 include similar stepped capillary assemblies 334 and 346, respectively, reference to one shall include reference to the other and all their like parts, for purposes of convenience, unless stated otherwise. Capillary segments 338 are constructed to have increasing, or stepped, diameters in the direction of flow because it has been discovered that by providing stepped capillaries of increasing diameter, certain performance advantages over single capillary diameters are resulted. For instance, when employing carbon dioxide as the dense fluid, larger and harder snow particles can be generated from a relatively smaller feed supply of carbon dioxide. Also, starting with an internal capillary diameter as little about 0.5 mm (0.020 inches) in the first capillary segment, restricted flow into and down the capillary condenser tube is resulted. It has also been discovered that by manipulating the number of steps and incrementally increasing the capillary step diameters, various ranges of solid phase particle size distribution can be produced. Stepped capillary condensation more efficiently condenses the liquid and vapor to solid through sharp near-isobaric expansion cooling while also producing a more desirable range of impact shear stresses.

However, it should be noted that any system for producing carbon dioxide snow is well within the scope of the present invention. The operator 84 can view the treatment process and inspect the substrate 16 either through direct vision or with assistance of the inspection device 68.

A control panel 96 contains all the necessary control valves, pressure regulators, gauges and switches necessary to monitor and control the spray cleaning process. The control panel 96 contains a main power switch 98 which activates the entire system, a spray mode switch 100 which switches spray cleaning operations from continuous spray cleaning mode to stand-by mode or to pulse cleaning mode. The exemplary control panel 96 also contains a carbon dioxide pressure gauge 102 and a CDA or propellant pressure gauge 104. The control panel 96 contains a pulse cycle switch 106 which varies and controls the spray cleaning pulse rate in sub-second pulse increments from 1 to 10 cycles per second or more. A propellant pressure regulator 108 is included to control the carbon dioxide spray pressure from between 0.07 MPa (10 psi) and 1.72 MPa (250 psi) and a carbon dioxide snow metering valve 110 to control carbon dioxide snow flow from zero to about 45 Kg (100 pounds) per hour or more. Finally, the control panel 96 features a digital temperature controller 112 to control the spray propellant temperature between 20 C and 200 C.

Figure 7:
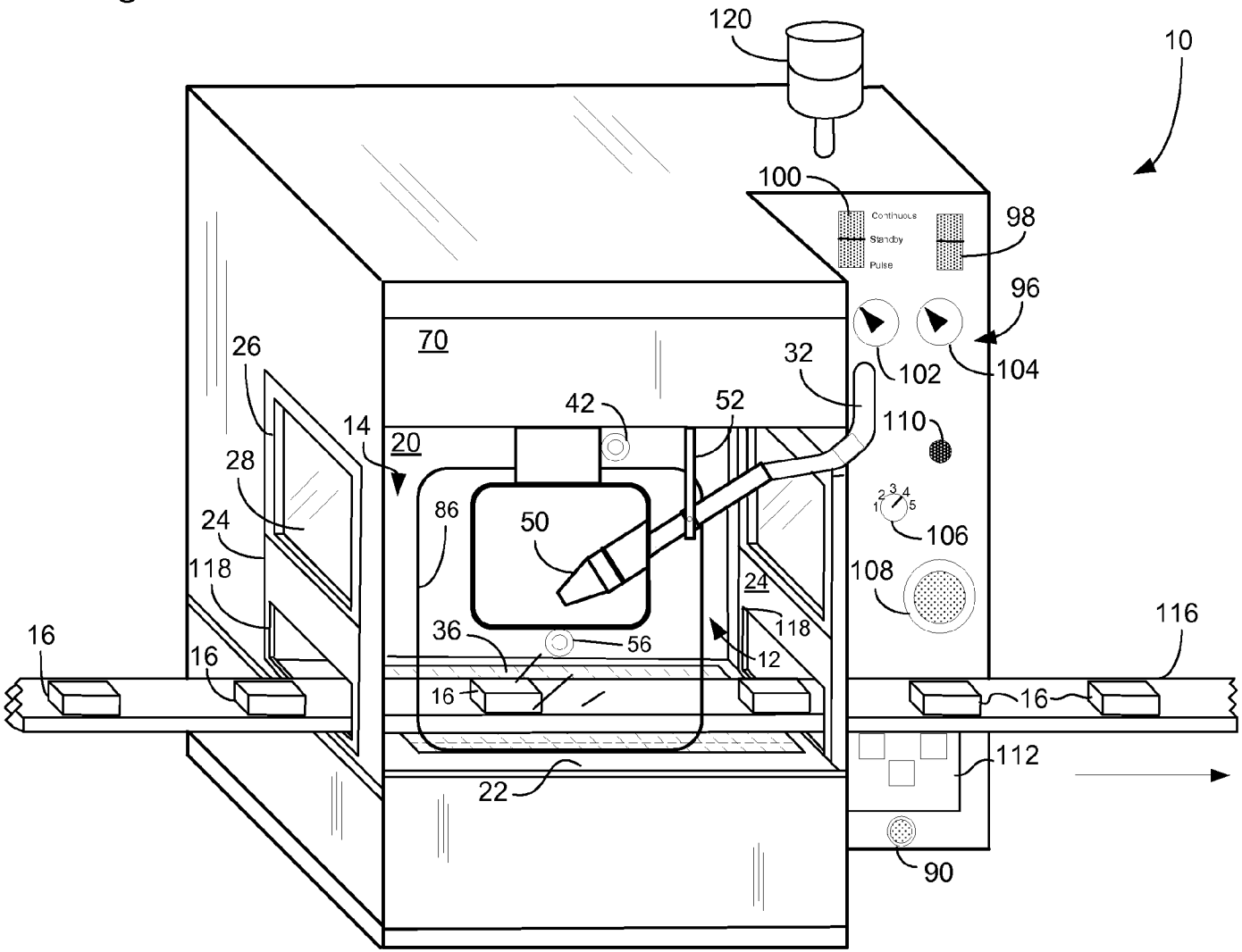
FIG. 7 is a perspective view of the present invention illustrating the incorporation of a conveyor belt.

Alternatively, and referring to FIG. 7, an automatic in-line cleaning conveyor 116 is incorporated. Upon incorporating the in-line cleaning conveyor, side panels 24 include lower apertures 118 that allow the conveyor 116 and substrates 16 to pass therethrough during operation. Also, a process indicator light 120 is included to indicate the operating mode of the cleaning system along with a machine controller (not shown) to coordinate operations between the conveyor 116 and the spray cleaning nozzle 50. In operation, the conveyor 116 travels through the lower apertures of the side panels 24 and into the cavity 14 of the cleaning system to position each substrate 16 proximate to the spray applicator 50. The conveyor 116 may proceed continuously through the cleaning cavity 14, or may pause momentarily at selected intervals to allow the spray applicator 50 to adequately treat each substrate 16. After treatment, the conveyor 116 carries the treated substrate 16 out of the cavity 14 and to the next stage in the processing, if any.

Although the present invention has been described with reference to preferred embodiments, workers skilled in the art will recognize that changes may be made in form and detail without departing from the spirit and scope of the invention.

The invention claimed is:

1. An apparatus for treating a substrate with a cryogenic impingement fluid comprising:

a protective enclosure defining an internal cavity;

a cryogenic fluid applicator positioned within the internal cavity; and a snow generation system connected to the cryogenic fluid applicator, the snow generation system including a condenser having a first capillary segment connected to a liquid carbon dioxide feed line and a second capillary segment attached to the first capillary segment, the second capillary segment having a greater inner diameter than the first capillary segment, wherein liquid carbon dioxide enters the first capillary segment from the liquid carbon dioxide feed line and progresses toward the second segment, whereupon entering the second segment, at least a portion of the liquid carbon dioxide condenses into solid carbon dioxide particles.

2. The apparatus of claim 1 and further comprising a third capillary segment attached to the second capillary segment, the third capillary segment having a greater inner diameter than the second capillary segment, whereupon passing from the second capillary segment into the third capillary segment at least a portion of the liquid carbon dioxide further condenses.

3. The apparatus of claim 1 wherein each capillary segment is flexible.

4. The apparatus of claim 1 and further comprising an insulator contacting an outer surface of each capillary segment.

5. The apparatus of claim 1 wherein the snow generation system further comprises a conduit, the condenser positionable therein, wherein a gas or fluid is transportable through the conduit and about the condenser.

6. The apparatus of claim 1 wherein the inner diameter of each capillary segment is less than 3 millimeters.

7. The apparatus of claim 1 wherein the second capillary segment includes a length greater than 500 millimeters.

8. An apparatus for treating a substrate with a cryogenic impingement fluid comprising:

a protective enclosure defining an internal cavity;

a cryogenic fluid applicator positioned within the internal cavity; and a snow generation system connected to the cryogenic fluid applicator, the snow generation system comprising:

a first flexible tube; and a second flexible tube adjoined to the first tube, the second tube having a greater inner diameter than the first tube, whereupon introducing liquid carbon dioxide into the first tube, the liquid carbon dioxide progresses to the second tube, whereupon entering the second tube at least a portion of the liquid carbon dioxide condenses to form solid carbon dioxide particles.

9. The apparatus of claim 8 and further comprising a third tube adjoined to the second tube, the third tube having a greater inner diameter than the second tube, whereupon entering the third tube from the second tube, at least a portion of the liquid carbon dioxide further condenses.

10. The apparatus of claim 8 wherein the snow generation system further comprises an insulator contacting an outer surface of each tube.

11. The apparatus of claim 8 wherein the snow generation system further comprises a conduit, the first and second tube positionable therein, wherein a gas or fluid is transportable through the conduit and about the first and second tubes.

12. The apparatus of claim 8 wherein the inner diameter of each tube ranges from about 0.12 millimeters to less than 3 millimeters.

13. The apparatus of claim 8 wherein each tube has a length ranging from about 0.3 meters to about 7.3 meters.

14. The apparatus of claim 13 wherein each tube has a length ranging from greater than 0.5 meters to about 7.3 meters.

15. The apparatus of claim 8 wherein at least one tube includes a polymeric construction to provide an insulating effect.

16. An apparatus for treating a substrate with a cryogenic impingement spray comprising:

a protective enclosure defining an internal cavity;

a cryogenic impingement spray applicator positioned within the internal cavity; and a cryogenic impingement spray generator connected to the applicator, the generator comprising:

a first tube;

a second tube connected to the first tube, the second tube having a greater inner diameter than the first tube; and a third tube connected to the second tube, the third tube having a greater inner diameter than the second tube, wherein liquid carbon dioxide enters the first tube and progresses toward the second tube, whereupon entering the second tube at least a portion of the liquid carbon dioxide condenses into solid carbon dioxide particles, whereupon passing from the second tube to the third tube at least a portion of the remaining liquid carbon dioxide further condenses onto the solid carbon dioxide particles.

17. The apparatus of claim 16 wherein the cryogenic impingement spray generator further comprises an insulator contacting an outer surface of each tube.

18. The apparatus of claim 16 wherein the cryogenic impingement spray generator further comprises a conduit, each tube positionable therein, wherein a gas or fluid is transportable through the conduit and about each tube.

19. The apparatus of claim 16 wherein each tube has a length ranging from about 0.3 meters to about 7.3 meters.

20. The apparatus of claim 16 wherein the inner diameter of each tube ranges from about 0.12 millimeters to about 3.18 millimeters.

* * * * *